United States Patent [19]

Wittmoser

[11] 4,085,790

[45] Apr. 25, 1978

[54] CASTING METHOD USING CAVITYLESS MOLD

[75] Inventor: Adalbert Wittmoser, Lampertheim, Germany

[73] Assignee: Grünzweig & Hartmann und Glasfaser AG, Ludwigshafen, Germany

[21] Appl. No.: 682,037

[22] Filed: Apr. 30, 1976

[30] Foreign Application Priority Data

May 2, 1975 Germany ..... 2519463

[51] Int. Cl.[2] ..... B22C 15/20; B22C 9/04

[52] U.S. Cl. ..... 164/7; 164/34; 164/62; 164/171

[58] Field of Search ..... 164/33, 34, 38, 61, 164/62, 246, 254, 256, 376, 37, 63, 170, 171, 172, 138, 7, 195, 160, 379, 383, 159, 161, 162, 169; 249/112, 127; 425/DIG. 44, 405 H, 405 R; 264/DIG. 50, 313, 314, 317, 221, 225, 321

[56] References Cited

U.S. PATENT DOCUMENTS

| | | | |
|---|---|---|---|
| 2,173,593 | 9/1939 | Phelps | 264/DIG. 50 |
| 3,410,942 | 11/1968 | Bayer | 164/34 UX |
| 3,572,421 | 3/1971 | Mezey | 164/34 X |
| 3,868,986 | 3/1975 | Olsen | 164/7 |

FOREIGN PATENT DOCUMENTS

| | | | |
|---|---|---|---|
| 715,972 | 8/1965 | Canada | 164/171 |
| 853,757 | 11/1960 | United Kingdom | 164/170 |

*Primary Examiner*—Francis S. Husar
*Assistant Examiner*—John S. Brown
*Attorney, Agent, or Firm*—Karl F. Ross

[57] ABSTRACT

A casting mold filled with free-flowing particulate matter such as sand, in which there is imbedded a vaporizable insert or pattern of wax, foam polymer or the like conforming to the shape of the desired casting, has at least two of its walls formed by flexible membranes exposed to the atmosphere for creating a more or less isobaric pressure upon the application of suction to its interior. One membrane may span the open top of a four-sided rigid shell whose perforated bottom is overlain by another such membrane; alternatively, with the sidewalls of the shell also perforated and/or vertically ribbed or fluted, five membranes may be combined into an open-topped bag lining the interior of the shell, the top of the bag being closed by a sixth membrane after introduction of the sand filling and its pattern insert.

2 Claims, 7 Drawing Figures

CASTING METHOD USING CAVITYLESS MOLD

FIELD OF THE INVENTION

My present invention relates to the casting of a metallic article by the cavityless molding method.

BACKGROUND OF THE INVENTION

In producing articles of steel or other metal by this known method, an insert or core termed a pattern having the shape of the desired casting, is imbedded in a mass of free-flowing refractory particulate matter such as sand, the insert consisting of wax, foam polymer or similar low-melting material which vaporizes under the heat of the molten metal introduced into its site. As the vapors diffuse through the surrounding sand, the metal completely fills the void left in the mass and, upon hardening of the casting, can be readily extracted therefrom.

In order to maintain the surrounding sand mass in a sufficiently compacted state, it is customary to place it under a pressure differential by subjecting it to atmospheric or superatmospheric pressure from above, via the open top of the mold, while generating (if necessary) a partial vacuum within the mold to hold the sand particles firmly together.

With certain types of casting, e.g. those of T or H profile in which a broad horizontal web or flange shields lower areas of the pattern from the exerted pressure, this unidirectional compaction of the flowable mass is unsatisfactory and may result in an objectionable deformation of thin-walled parts of the pattern leading to corresponding shape deviations of the finished casting. Conversely, the lack of sufficient density of the particulate mass at shielded locations may allow the molten metal to expand beyond the boundaries of the vaporizing pattern and to penetrate into the mass so as to produce undesirable excrescences on the surface of the casting. If the insert is originally encased in an antibonding layer designed to prevent adhesion between the metal and the surrounding sand, that layer could be locally ruptured by the penetration of the metal flow into the insufficiently compacted mass, thus further impairing the finished article.

OBJECT OF THE INVENTION

The object of my present invention, therefore, is to provide an improved method of casting such articles by cavityless molding with avoidance of the aforestated drawbacks.

SUMMARY OF THE INVENTION

In accordance with my present invention, a casting mold is provided with at least two movable wall members formed by fluidtight membranes, with establishment across each of these membranes of a pressure differential tending to compact the mass from opposite sides around the vaporizable pattern prior to introduction of the molten metal into the mold. As discussed above, the pressure differential may be provided by the exertion of a superatmospheric pressure from without (e.g. by placing the mold in a high-pressure chamber) or, advantageously, by the creation of suction within the mold.

In principle, the membranes forming the wall members may consist of a wide variety of deformable sheet materials including paper, metal, rubber and solid or cellular plastics. In order to minimize the risk of burning or smoke evolution, they may be made from solid particles such as powdered alumina held together by an elastomeric binder, e.g. silicone rubber; the binder, aside from bonding the solid particles to one another, also fills the intervening interstices to provide the necessary fluidtightness.

BRIEF DESCRIPTION OF THE DRAWING

The above and other features of the invention will now be described in detail with reference to the accompanying drawing in which.

SPECIFIC DESCRIPTION

Figure 1A:
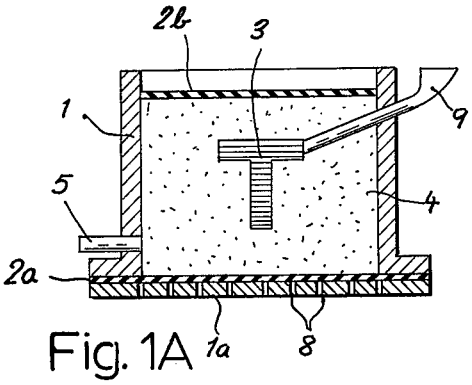
FIGS. 1A and 1B are cross-sectional views of a mold according to my invention, prior to and during the application of suction, used in forming a T-profile casting.
Figure 1B:
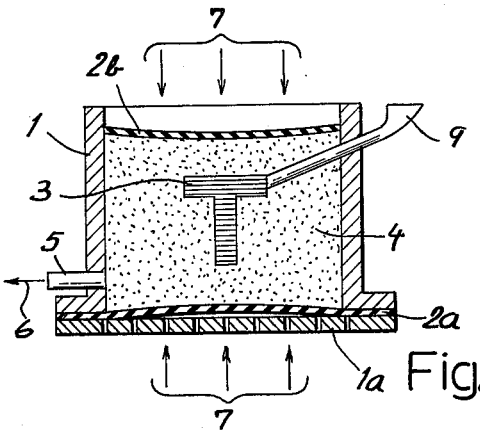

In FIGS. 1A and 1B I have shown a mold with a rigid shell 1, in the form of a four-sided prismatic box, whose bottom is formed by a rigid plate 1*a* with an array of uniformly distributed perforations 8 and by an overlying first membrane 2*a* of the aforedescribed character; a second, similar membrane 2*b* spans the open top of the mold to form a space which is sealed against the outside except for an exhaust pipe 5, leading to a suction pump not shown, and one or more inlets 9 through which molten metal can be introduced. The space within the mold is occupied by a binderless sand mass 4 in which a core 3 of wax, foam polymer or the like, constituting a vaporizable pattern, is imbedded.

Upon the application of a partial vacuum to pipe 5, as indicated by an arrow 6 in FIG. 1B, a pressure differential symbolized by arrows 7 is simultaneously developed across both membranes 2*a*, 2*b* so that the mass 4 is compacted from opposite sides around the pattern 3 which in this case has a T-profile with the web transverse to the two membranes. It will thus be apparent that there are no dead corners within the mold which would be shielded from the exerted pressure; the sand mass 4 is therefore uniformly compressed to maintain the shape of the pattern 3 and of the casting subsequently taking its place as hot, molten metal is introduced into the site of that pattern via the inlet or inlets 9.

Figure 2A:
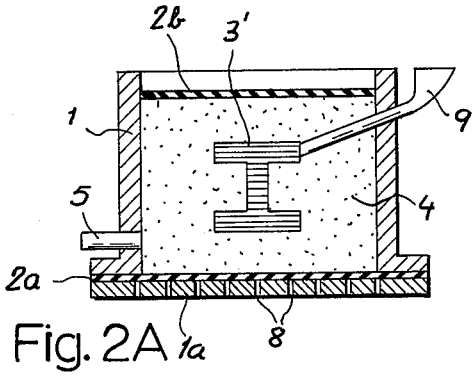
FIGS. 2A and 2B are views similar to FIGS. 1A and 1B, respectively, showing the same mold employed for producing an H-profile casting.
Figure 2B:
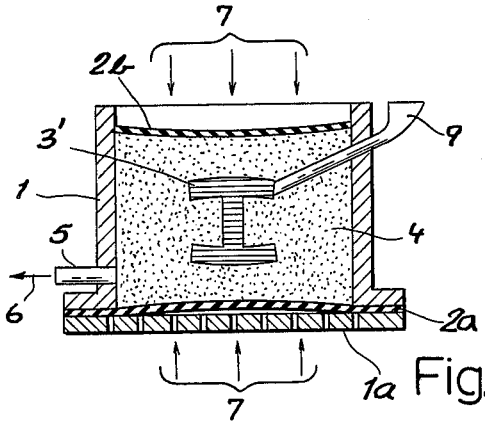

FIGS. 2A and 2B depict the same mold shell 1 with a pattern 3' having the shape of an H-profile, the web of the profile being again perpendicular to the membranes 2*a*, 2*b*. In this instance, however, compaction may be insufficient between the flanges of the "H", resulting in a deformation of the pattern 3' as exaggeratedly illustrated in FIG. 2B. This drawback is obviated by the improved construction of FIGS. 3A and 3B where the prismatic shell 1 has its sidewalls provided with internal vertical ribs 1' and with perforations 8' opening into the intervening grooves or flutes whereby atmospheric pressure acts not only upon the lower and upper membranes 2*a*, 2*b* but also upon two similar membranes 2*c*, 2*d* lining these sidewalls so that, with the application of suction to the interior of the mold via pipe 5, a pressure differential 7 is developed on four sides. In this way, as seen in FIG. 3B, a deformation of the H-profile core 3' is avoided. The perforations 8' may be omitted, since the flutes are vented at the top of the mold, but their presence insures a more uniform pressure distribution.

In like manner, the two remaining sidewalls of the prismatic shell 1 can be fluted or ribbed, as indicated at 1'', and provided with nonillustrated perforations, if desired, in order to establish a pressure differential across two further membranes (not shown in FIGS. 3A and 3B) constituting a continuous flexible liner with membranes *2a*, *2c* and *2d* to which they may be secured adhesively or by other suitable means. The upper membrane *2b*, topping the liner, should be at least partly detachable therefrom in all instances to facilitate insertion of the sand mass 4 and the pattern 3 or 3' as well as the removal of the finished casting. The ribs 1', 1'' may be omitted in the case of uniformly perforated sidewalls; on the other hand, the mold bottom *1a* could also be corrugated, i.e. provided with ribs and flutes, for more effective pressurization.

Naturally, my invention is also applicable to differently shaped molds, e.g. those with a cylindrical shell centered on a vertical axis. With downwardly pointing exhaust pipes 5, for example, liners in the form of prismatic or cylindrical bags made from flexible membranes may be bodily extracted from the shell for filling and emptying. A four-sided prismatic bag of this type, fitting into the shell 1 of FIGS. 3A and 3B, has been illustrated in FIG. 4 (without the top membrane *2b*); an inlet tube 9 for the melt extends upwardly from the bag and need not pass through one of the shell walls. It will be understood that this bag, being flexible, assumes its illustrated shape only when inserted as a liner into a correspondingly shaped mold shell as shown in the preceding Figures.

Figure 3A:
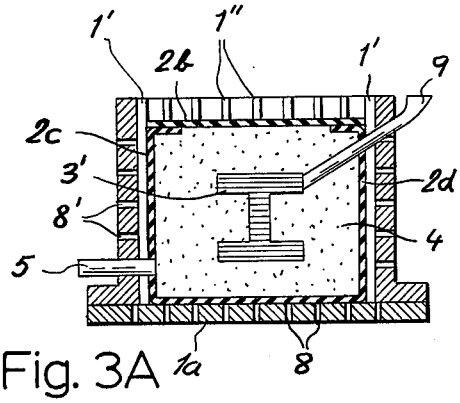
FIGS. 3A and 3B are analogous views of an improved mold particularly designed for castings of the general type shown in FIGS. 2A and 2B.
Figure 3B:
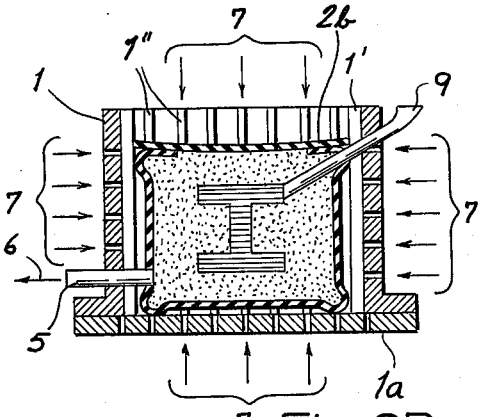
Figure 4:
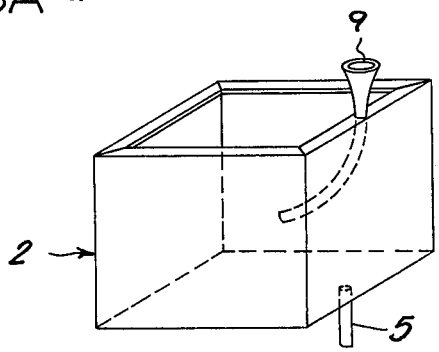
FIG. 4 is an isometric view of a flexible liner for a mold of the type shown in FIGS. 3A and 3B.

The several membranes, though shown flat in their unstressed state as illustrated in FIGS. 1A, 2A and 3A, could also be preshaped with external concavities so as to be only inwardly deformable.

I claim:

1. A method of casting a metallic article, comprising the steps of:

providing a cavityless mold bounded by flexible membranes on at least one pair of opposite sides as well as on its top and bottom;

filling said mold with a free-flowing mass of refractory particles;

imbedding in said mass a pattern of vaporizable material conforming to the shape of the article to be cast;

compacting said mass from said opposite sides and from said top and bottom between said membranes by simultaneously exerting upon said membranes an external fluid pressure exceeding the internal pressure of said mold; and introducing molten metal into said mold in the presence of said fluid pressure for vaporizing said pattern while forming the desired article in its place.

2. A method as defined in claim 1 wherein said external fluid pressure is exerted by exposing said membranes to the atmosphere while creating suction within the mold.

* * * * *